US009248380B1

(12) United States Patent
Long

(10) Patent No.: US 9,248,380 B1
(45) Date of Patent: Feb. 2, 2016

(54) PROGRAMMABLE DANCING FIGURINE AND METHOD OF CONDUCTING A PERFORMANCE USING THE SAME

(71) Applicant: Lana Long, Hephzibah, GA (US)

(72) Inventor: Lana Long, Hephzibah, GA (US)

( * ) Notice: Subject to any disclaimer, the term of this patent is extended or adjusted under 35 U.S.C. 154(b) by 0 days.

(21) Appl. No.: 14/506,858

(22) Filed: Oct. 6, 2014

Related U.S. Application Data

(60) Provisional application No. 61/961,184, filed on Oct. 7, 2013.

(51) Int. Cl.
*A63H 13/00* (2006.01)
*A63H 13/02* (2006.01)

(52) U.S. Cl.
CPC ..... *A63H 13/02* (2013.01)

(58) Field of Classification Search
CPC ..... A63H 3/28; G09B 19/0015
See application file for complete search history.

(56) References Cited

U.S. PATENT DOCUMENTS

| | | | | |
|---|---|---|---|---|
| 5,056,249 | A | 10/1991 | Sakurai | |
| 6,652,351 | B1 * | 11/2003 | Rehkemper et al. | 446/354 |
| 6,746,301 | B1 | 6/2004 | Lund et al. | |
| 6,758,716 | B1 * | 7/2004 | Rehkemper et al. | 446/297 |
| 7,291,054 | B2 * | 11/2007 | Choi | 446/454 |
| 2009/0104841 | A1 | 4/2009 | Yen | |
| 2010/0221978 | A1 * | 9/2010 | Long | 446/298 |

* cited by examiner

*Primary Examiner* — Jay Liddle
*Assistant Examiner* — Alex F. R. P. Rada, II
(74) *Attorney, Agent, or Firm* — Hanrahan Law Firm, P.A.; Benjamin M. Hanrahan

(57) ABSTRACT

A programmable dancing figurine visually representative of a religious or biblical figure, and a method of conducting a dance routine with the programmable dancing figurine are presented herein. The method includes selecting a song or biblical verse and defining a dance portion of the song, which may begin on the first lyric and end on the last lyric of the song. Utilizing a remote control disposed in a communicative relation with the figurine, the user will pre-program one or more dance routes by consecutively selecting a particular button mode and a button corresponding to a dance maneuver. During the performance, the user must synchronize or time the execution of the dance routine with the dance portion of the song, wherein the collective time it takes to perform the pre-programmed dance routine(s) must be substantially equal to the time of the dance portion of the song.

15 Claims, 11 Drawing Sheets

| Button Mode | Button Reference Character (See Figure 4) | Brief Description of Dance Maneuver | Approximate Time to Execute Dance Maneuver |
|---|---|---|---|
| MODE 1 (E.G., RED LIGHT) | 60 | Right Arm Up (See, e.g., Figure 5A) | 2 seconds |
| | 61 | Right Arm Down (See, e.g., Figure 5B) | 1 second |
| | 62 | Right Arm Inward (See, e.g., Figure 5C) | 1 second |
| | 63 | Right Arm Out (See, e.g., Figure 5D) | 1 second |
| | 64 | Tilt Body Right (See, e.g., Figure 5E) | 2 seconds |
| | 65 | Left Arm Up (See, e.g., Figure 5F) | 2 seconds |
| | 66 | Left Arm Down (See, e.g., Figure 5G) | 1 second |
| | 67 | Left Arm Inward (See, e.g., Figure 5H) | 1 second |
| | 68 | Left Arm Out (See, e.g., Figure 5I) | 1 second |
| | 69 | Tilt Body Left (See, e.g., Figure 5J) | 2 seconds |
| | 70 | Turn Right | 1 second |
| | 71 | Walk Forward Press once for one step, twice to move slowly | NA |
| | 72 | Turn Right | 1 second |
| | 73 | Walk Backward Press once for one step, twice to move slowly | NA |
| | 74 | Stop | 0 seconds |

FIG. 6A

| Button Mode | Button Reference Character (See Figure 4) | Brief Description of Dance Maneuver | Approximate Time to Execute Dance Maneuver |
|---|---|---|---|
| MODE 2 (E.G., GREEN LIGHT | 60 | Right Hand Thump, (lift right arm, followed by pressing downward) | 3 seconds |
| | 61 | Stand and Lean Right | 4 seconds |
| | 62 | Lean Back and Open Arms | 1 second |
| | 63 | Right Hand Tossing Motion | 4 seconds |
| | 64 | Sleep Mode | 2 seconds |
| | 65 | Left Hand Thump, (lift left arm, followed by pressing downward) | 3 seconds |
| | 66 | Stand and Lean Left | 4 seconds |
| | 67 | Lean Forward and Close Arms | 1 second |
| | 68 | Left Hand Tossing Motion | 5 seconds |
| | 69 | Sleep Mode | 2 seconds |
| | 70 | Turn 45 Degrees Right | 4 seconds |
| | 71 | Two Steps Forward | 4 seconds |
| | 72 | Turn 45 Degrees Left | 4 seconds |
| | 73 | Two Steps Backward | 4 seconds |
| | 74 | Stop | 0 seconds |

FIG. 6B

| Button Mode | Button Reference Character (See Figure 4) | Brief Description of Dance Maneuver | Approximate Time to Execute Dance Maneuver |
|---|---|---|---|
| MODE 3 (E.G., ORANGE LIGHT | 60 | Right Hand Sweep (knock items forward with sweeping arm and waist motion) | 3 seconds |
| | 61 | High 5 Motion | 5 seconds |
| | 62 | Strike or Chop with Right Hand | 3 seconds |
| | 63 | No action | NA |
| | 64 | Another Strike or Chop with Right Hand | 4 seconds |
| | 65 | Left Hand Sweep (knock items forward with sweeping arm and waist motion) | 3 seconds |
| | 66 | No action | NA |
| | 67 | Strike or Chop with Left Hand | 3 seconds |
| | 68 | No action | NA |
| | 69 | Another Strike or Chop with Right Hand | 4 seconds |
| | 70 | Right Hand Strike | 3 seconds |
| | 71 | 8 Steps Forward | 8 seconds |
| | 72 | Left Hand Strike | 3 seconds |
| | 73 | Multiple Hand Gestures | 8 seconds |
| | 74 | Lift Both Arms | 3 seconds |

FIG. 6C

PROGRAMMABLE DANCING FIGURINE AND METHOD OF CONDUCTING A PERFORMANCE USING THE SAME

CLAIM OF PRIORITY/CROSS REFERENCE TO RELATED APPLICATION

The present application is based on and a claim to priority is made under 35 U.S.C. §119(e) to provisional patent application Ser. No. 61/961,184, having a filing date of Oct. 7, 2013, the contents of which are incorporated herein their entirety.

FIELD OF THE INVENTION

The present invention is generally directed to a programmable dancing figurine and a method of conducting a performance using the programmable dancing figurine. The method described herein may be used to teach or improve coordination skills, listening skills, time management skills, and other learning skills. The figurine may be configured to visually represent a religious or biblical character, figure or individual.

BACKGROUND OF THE INVENTION

Teaching coordination, timing, and other skills in children and adults may be accomplished by way of choreographing dance routines to music, songs, and biblical verses. There is a need for a biblical figurine that can be programmed by a user to execute successive dance moves or other movements to synchronized music. In order to do so, the user would have to listen to a particular song or biblical verse, generally a number of times, and coordinate the movement of the figurine to the song or biblical verse. Such a method and figurine may be used to not only teach and develop coordination and other skills, but can be used to teach the importance of religion via the various song or biblical verses used.

SUMMARY OF THE INVENTION

The present invention is generally directed to a programmable figurine and a method of conducting a dance routine with the figurine. In particular, the method includes selecting a song and defining a dance portion of the song. In many cases, the dance portion will being on the first lyric of the song and end on the last lyric or last note of the song, however, other portions of the song may be defined as a dance portion, as desired.

The length of the dance portion is determined, and the figurine is pre-programmed, or otherwise programmed prior to the performance, such that when the dance performance is executed, the user need only run or execute the pre-programmed dance routine(s) at the designated time(s). The dance routines are defined as a plurality of dance maneuvers or other actions performed by the figurine as programmed by the user.

In order to pre-program the dance routine via the provided remote control, the user will first select a button mode followed by a selection of a dance maneuver by pressing a particular button associated with the dance maneuver. In certain embodiments, a single button may be associated with a plurality of dance maneuvers. The current button mode will determine which of the plurality of dance maneuvers is selected.

Once the entire dance routine is pre-programmed via the remote control, the user is ready to being the performance by playing the selected song, and upon commencement of the dance portion thereof, executing the dance routine via the remote control. The figurine will then preform the pre-programmed dance maneuvers while the song plays. The ultimate goal is to have the dance begin at a certain point (e.g., the beginning of the dance portion of the song) and automatically end at a certain point (e.g., the end of the dance portion of the song). If the figurine does not synchronize with the dance portion of the song (e.g., if the dance maneuvers end before the end of the dance portion or after the end of the dance portion), then the user may repeat the pre-programming steps to correct the timing.

These and other objects, features and advantages of the present invention will become more apparent when the drawings as well as the detailed description are taken into consideration.

BRIEF DESCRIPTION OF THE DRAWINGS

FIGS. 6A through 6C are charts illustrating exemplary actions associated with certain remote control buttons for each button mode, and the corresponding estimated length of time to complete each action or dance maneuver.

Like reference numerals refer to like parts throughout the several views of the drawings provided herein.

DETAILED DESCRIPTION OF THE INVENTION

Figure 1:
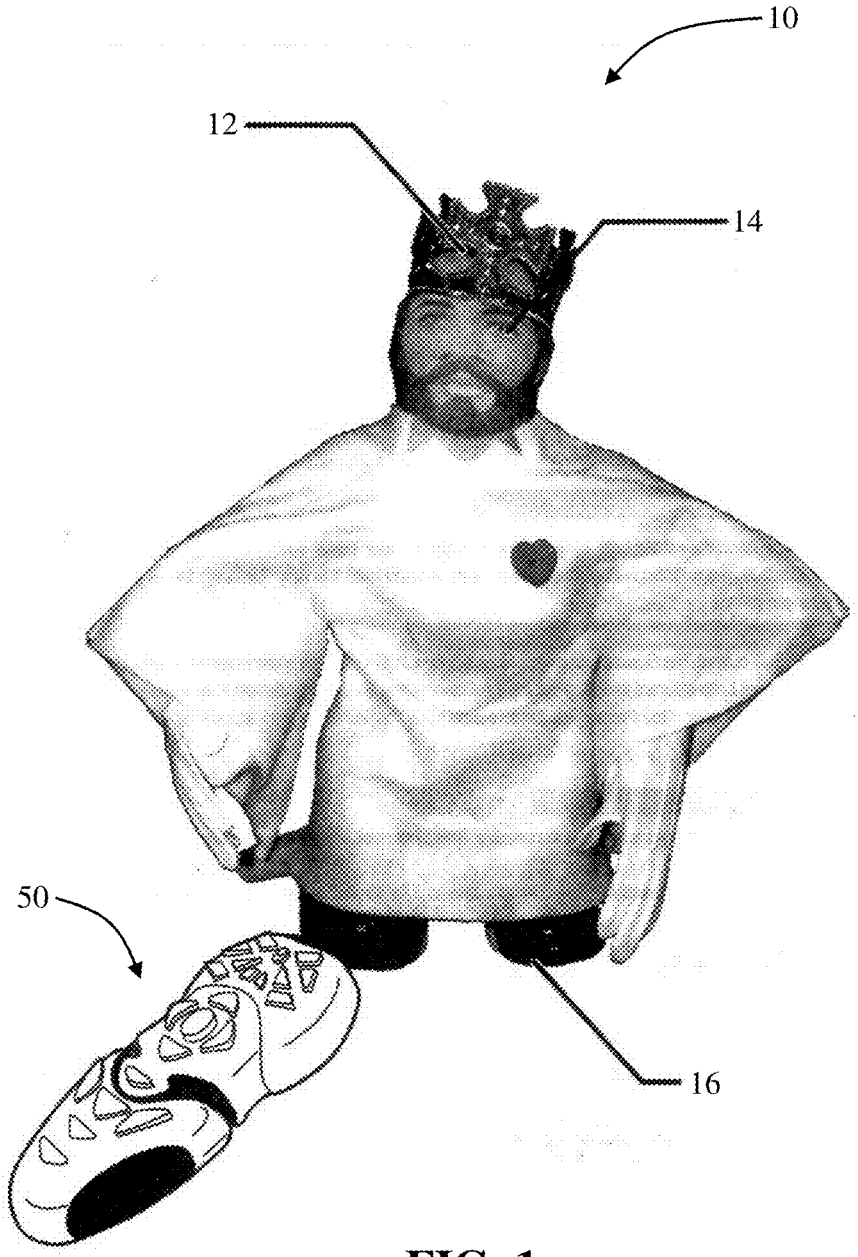
FIG. 1 is a front view of the programmable dancing figurine and remote control as disclosed in accordance with at least one embodiment of the present invention.
Figure 2:
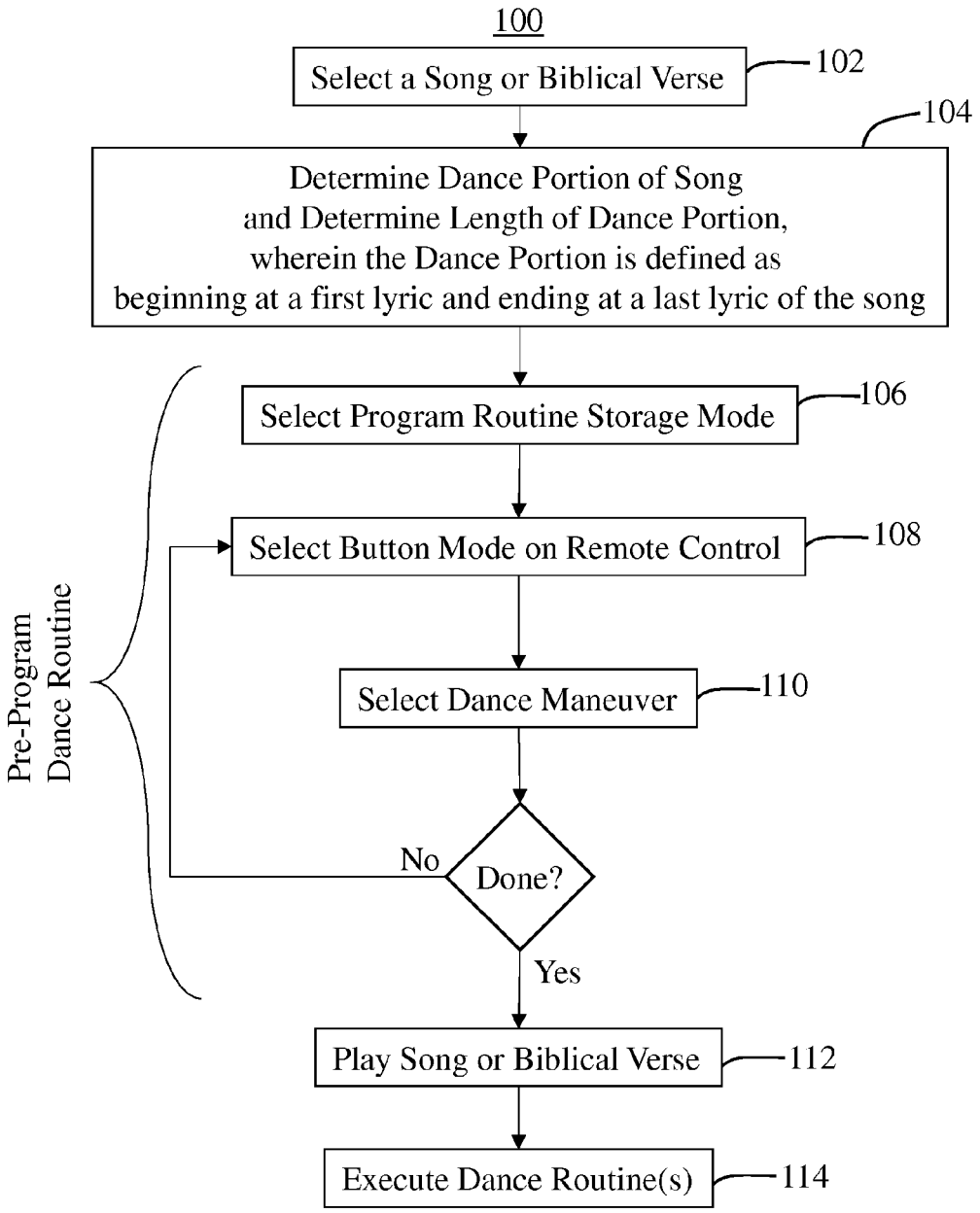
FIG. 2 is a high level flow chart illustrating a method of conducting a performance in accordance with at least one embodiment of the present invention.
Figure 3:
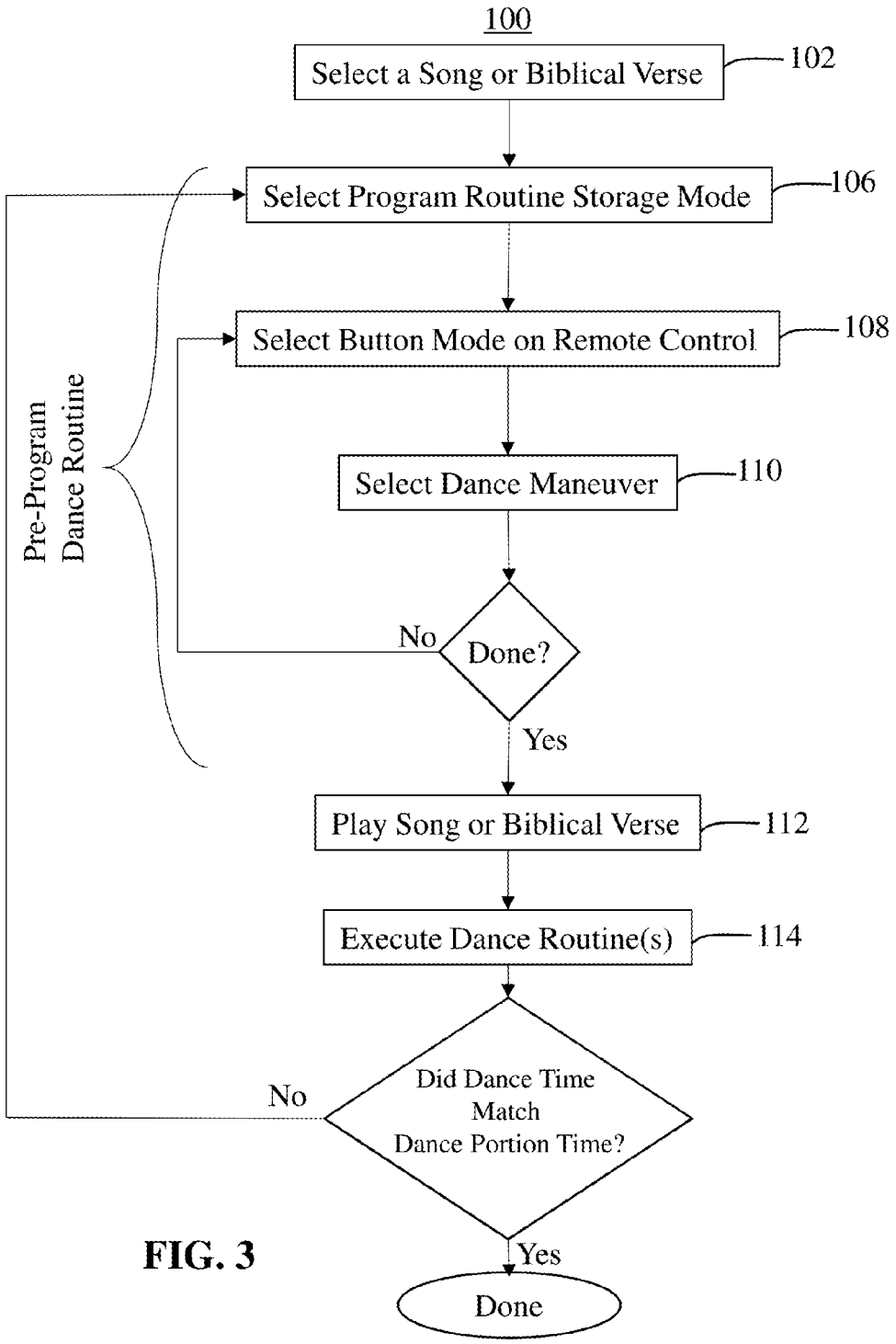
FIG. 3 is a high level flow chart illustrating another method of conducting a performance in accordance with another embodiment of the present invention.

As shown in the accompanying figures, and with particular reference to FIGS. 1 through 3, the present invention is directed to a programmable dancing figurine, represented as 10, and a method of conducting a performance via the programmable dancing figurine, generally represented as 100. In particular, the various embodiments of the present invention may be used to teach or improve various learning and coordination skills by pre-programming movement of the figurine 10 to synchronize or move with music, and timing the movements to correspond with certain aspects or portions of the music. Many embodiments of the figurine 10 are constructed to visually represent a biblical or religious individual or character, including but in no way limited to Jesus, and thus, certain embodiments may also be used to teach religion. As will be described herein, the figurine 10 may be synchronized to music or a song, wherein the music or song may also include biblical or religious teachings, although any song or music may be used in accordance with the various embodiments herein.

Referring to FIG. 1, the figurine 10 of the present invention may be pre-programmed or controlled by a remote control 50 disposed in a communicative relation therewith. For example, the user may pre-program dance maneuvers or routine(s) via the remote control 50 prior to the performance or executing the dance routine with synchronized music. In this manner, the remote control 50 and the figurine 10 may include infrared communication, radio communication, etc. in order to facilitate the appropriate communication there between. For instance, the figurine 10 may include a sensor 12, such as, but not limited to, in the upper head, face, or other portion for facilitating communicative relation with the remote control 50. Other features may include an illuminating eye 14 or other portion thereof structured to illuminate, blink or flash, for example, upon establishing a communicative link between the remote control 50 and the figurine 10. As an example, the eye(s) 14 may briefly illuminate, flash or blink when a button is pressed on the remote, when the figurine is turned on or power is provided to the figurine 10 (e.g., via batteries), etc. Furthermore, the figurine 10 of the various embodiments is equipped with a processor or computer chip, memory, and storage device (not shown) for facilitating implementation of the method 100 and other embodiments of the present invention.

Referring now to the flow chart of FIG. 2, the method 100 of at least one embodiment of the present invention may begin by selecting a song or music, generally represented at 102. While any song or music may be selected in accordance with certain embodiments of the present invention, biblical verses, religious melodies or songs, etc. may be preferred. It should also be noted that the song(s), as used herein, may include an introduction, lyrical portion, and an outro. Generally, the introduction of the song is defined as the initial portion of the song where there are little or no lyrics and mostly instrumental, although the introduction may vary from one song to another. The lyrical portion of the song generally begins from the first lyric and ends on the last lyric of the song, and the outro is defined as the portion of the song after the last lyric to the end of the song. It should be noted that many songs and musical compositions are organized in different manners and thus, the introduction, lyrical portion and outro may vary, and some songs may not include each of these three portions. In any event, as will be described herein, the method 100 of at least one embodiment of the present invention may include executing a pre-programmed dance routine during the lyrical portion of the song, or otherwise the dance portion of the song.

Accordingly, still referring to FIG. 2, the method 100 of at least one embodiment includes determining the length of a dance portion of the selected song, represented at 104. The dance portion of the song may include the entire lyrical portion, a section of the lyrical portion, the lyrical portion and the outro, etc. In any event, the method 100 of at least one embodiment, as shown in FIG. 2, may include determining the dance portion of the song 104, for example, prior to pre-programming the dance routine. This may require the user to listen to the song multiple times and plan the dance routine by determining when the dance will begin and when the dance will end relative to the song, song lyrics, and various portions of the song (e.g., introduction, lyrical portion and outro).

Next, in accordance with the method 100 of the present invention, the user must pre-program the figurine 10 by manipulating the remote control 50 and the various buttons on the remote control 50. In particular, the user must coordinate the figurine 10 to perform a plurality of successive dance maneuvers throughout the determined dance portion of the song, noting that each of the various dance maneuvers from which the user may choose take a certain amount of time to perform. Thus, timing of the dance routine (comprising a plurality of successive dance maneuvers) must be coordinated with the time of the determined dance portion of the song.

Furthermore, it should also be noted that in at least one embodiment, the figurine 10 may include a plurality of program routine storage modes, defined as separately, yet concurrently stored dance routines on the memory or storage device of the figurine 10. For example, in one embodiment there may be three (3) program routine storage modes (e.g., a master storage mode and two secondary storage modes) in that a user may be able to program or store three (3) or more separate dance routines, each dance routine comprising a plurality of successive dance maneuvers. Therefore, during the course of the song and performance, the user may need to execute different dance routines stored in different storage modes in order to time the overall performance with the dance portion of the song. In this manner, the user may execute a first dance routine stored in accordance with a first or Master program routine storage mode upon commencement of the dance portion of the song. During the dance portion or performance, the user may need to execute a second dance routine stored in accordance with a second or secondary program routine storage mode and/or a third dance routine stored in accordance with a third or another secondary program routine storage mode, etc.

Thus, in order to pre-program a dance routine, the method 100 of at least one embodiment may comprise selecting a program routine storage mode by pressing an appropriate button(s) on the remote control 50, as represented at 106 in FIG. 2. With a program routine storage mode selected or specified, the user may then begin to program the successive dance maneuvers associated with the selected program routine storage mode. Particularly, in at least one embodiment, the remote control 50 may include a plurality of buttons, some of which may correspond to particular dance maneuvers. Selecting a button corresponding to a dance maneuver will program the corresponding dance maneuver into the selected storage mode, as shown at 110.

However, it at least one embodiment, the remote control 50 and/or figurine 10 may include a plurality of button modes wherein some of the buttons on the remote control may correspond to or be associated with a plurality of different actions. For example, in at least one embodiment, there are three (3) button modes such that at least some of the buttons on the remote control 50 are associated with at most three different actions. An action may be defined as any command communicated from the remote control 50 to the figurine 10, including dance maneuvers and/or selecting a program routine storage mode, for example.

Accordingly, the particular invention includes a plurality of buttons on the remote control, many of which are assigned or associated with a plurality of different dance maneuvers depending upon which "mode" the remote control 50 is currently in. Selecting a button mode 108 may define or associate an action with a particular button. Thus, selecting a dance maneuver 110 may be accomplished by selecting or pressing a particular button on the remote control 50 while the remote control is in a selected button mode. For instance, a single button may be used to program a plurality of different dance maneuvers depending on the particular button mode selected. The user will then repeat the button mode selection and the dance maneuver selection in order to program a plurality of successive dance maneuvers. As many of the dance maneuvers take different amounts of time to complete, the user must coordinate and plan the dance maneuvers to correspond with the particular song and the determined dance portion thereof. For example, in one embodiment, the user may know the amount of time it takes for each dance maneuver and may know the amount of time in the dance portion of the song. Thus, when programming the dance maneuvers, the user must be able to effectively select appropriate dance maneuvers to synchronize with the selected song or dance portion thereof.

It should also be noted that, as mentioned herein, the figurine 10 may be structured to concurrently store a plurality of dance routines (via different program routine storage modes) such that the user may execute different dance routines throughout the performance. This may be accomplished by selecting a corresponding "execute" button on the remote control. However, certain embodiments of the figurine may include one or more touch sensors, motion sensors, light sensors, etc. generally referenced as 16 in FIG. 1, that, when activated may be structured to execute a particularly stored dance routine. For example, a secondary dance routine may be stored via the secondary storage mode, and may be executed by tapping on a corresponding sensor 16 on the figurine 10 itself, rather than using the remote control 50. The sensor(s) 16 may be activated upon touch, light, motion, etc.

In any event, when the user is finished pre-programming dance routine(s), the performance may begin. For instance, the user may place the figurine 10 on a generally flat surface or stage and being to play the selected song, as referenced at 112. This may be accomplished by an external music player or, in some embodiments, the figurine 10 may be structured and configured to store and/or play music.

Upon commencement of the determined dance portion of the song, for example, upon the first lyric of the song, the user may execute the dance routine(s), as shown at 114, for example, by selecting the appropriate button(s) on the remote control 50 and/or sensor(s) on the figurine 10 itself. If the dance routine(s) does not match or synchronize with the song or dance portion thereof, then the user must re-program the figurine 10 by adding or removing dance maneuvers or starting over.

FIG. 3 represents a modified version of the method 100 of at least one embodiment wherein the length of the dance portion of the song may not be known at the beginning or prior to programming the dance routine. In this manner, the user may use a trial-and-error technique by repeating the programming steps until the dance routine(s) synchronize with the dance portion of the song, or otherwise until the timing of dance routine(s) (e.g., the collective time it takes to execute the successive dance maneuvers) substantially equals the time corresponding to the dance portion or lyrical portion of the song.

Figure 4:
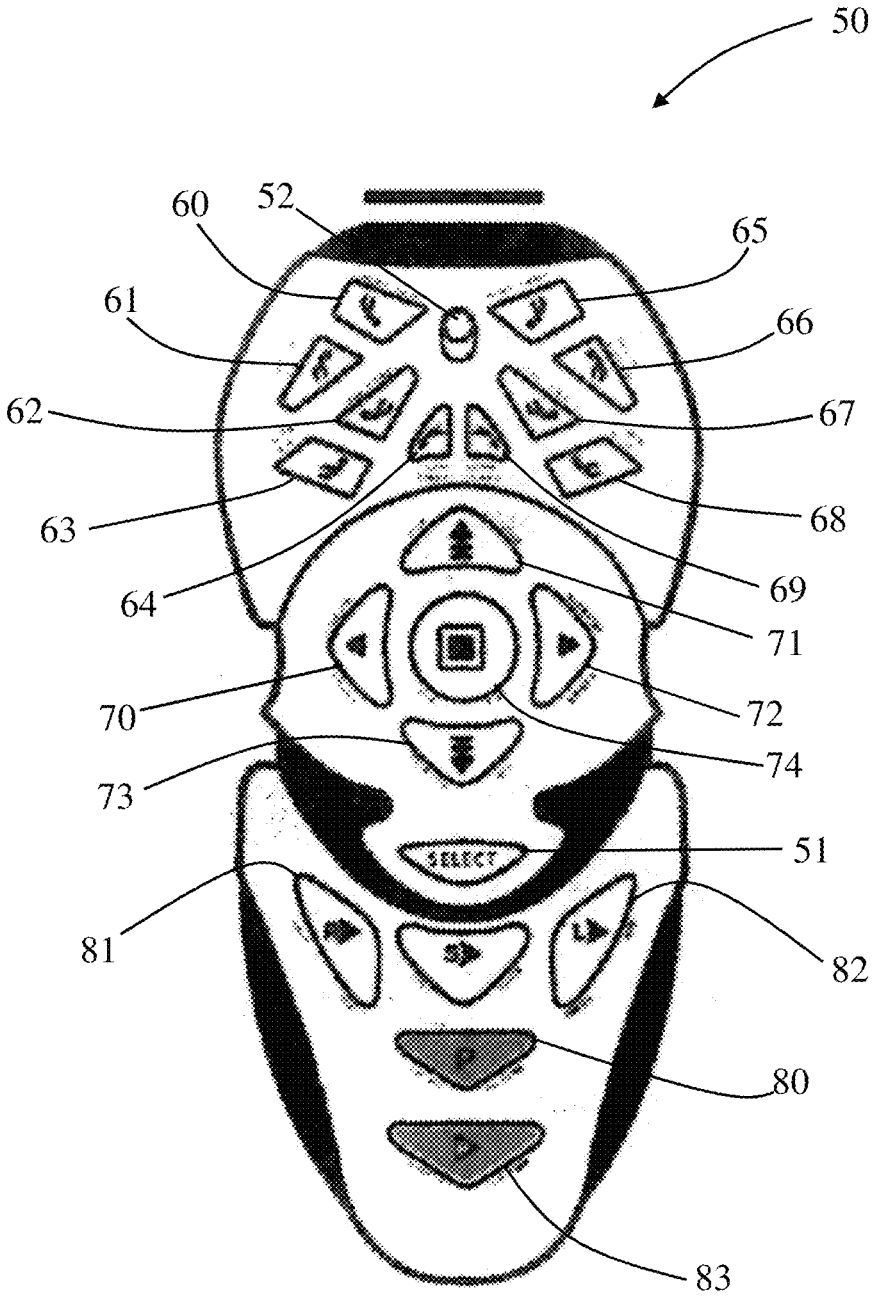
FIG. 4 is a top view of an exemplary remote control disclosed in accordance with at least one embodiment of the present invention.
Figure 5A:
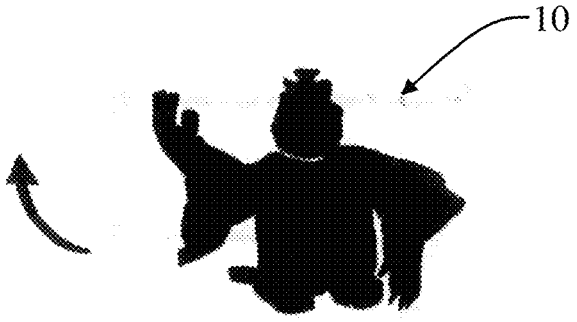
FIGS. 5A through 5J are schematic representations of exemplary dance maneuvers disclosed herein.
Figure 5B:
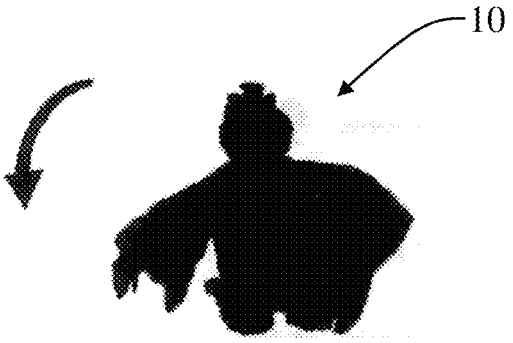
Figure 5C:
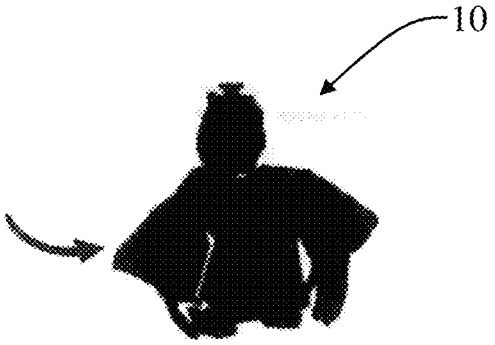
Figure 5D:
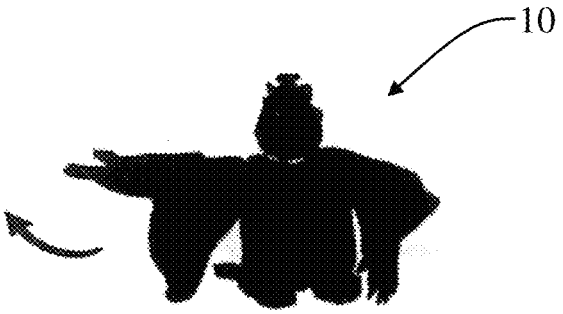
Figure 5E:
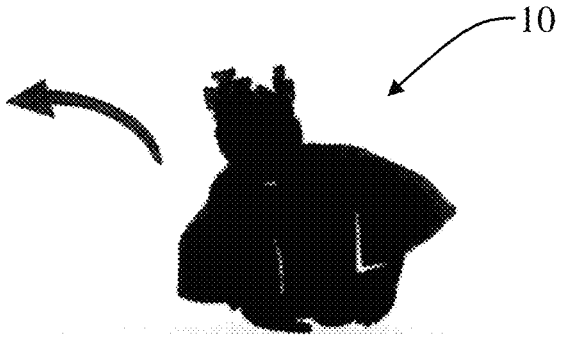
Figure 5F:
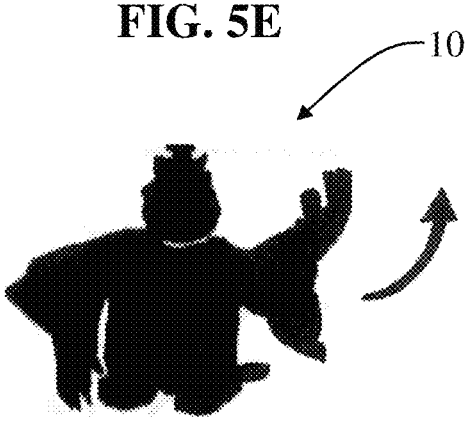
Figure 5G:
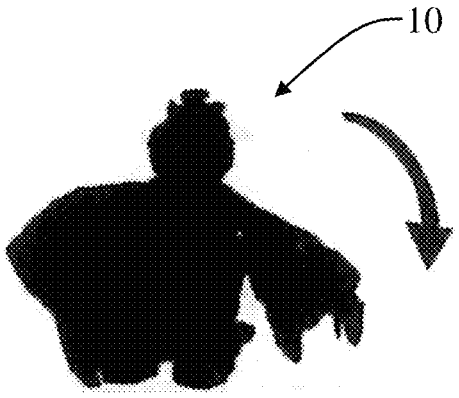
Figure 5H:
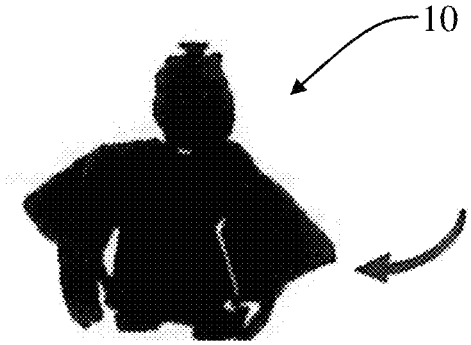
Figure 5I:
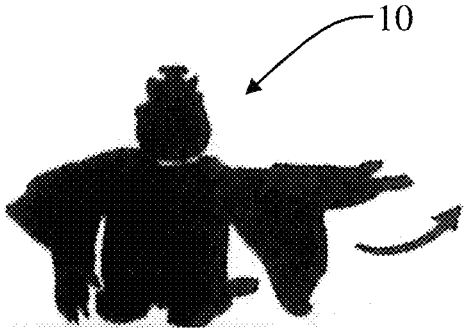
Figure 5J:
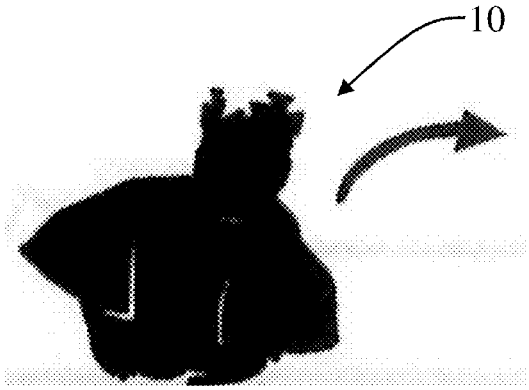

Referring now to FIG. 4, an exemplary remote control 50 is illustrated. To begin programming the dance routine or dance maneuvers, in accordance with at least one embodiment, the user must first select a particular button mode, which, as provided herein, will define what actions are associated with certain buttons on the remote control 50. In order to select the button mode, the user may successively select or depress the SELECT button, or other similar button, shown at 51. By doing so, the remote control 50 will change button modes with each selection or press of the SELECT button. In certain embodiments, the remote control 50 may include an LED, light or other indicator 52 which is structured to identify to the user what button mode is currently selected or activated. For example, the indicator 52 may change colors (e.g., red, green, orange) depending on the particular button mode selected or activated.

For example, in order to program the dance routine, the user may first need to select a particular program routine storage mode. In one embodiment, the user may select a program button 80, 81, 82 to select an appropriate one of the plurality of storage modes, keeping in mind that the button mode must be correctly selected in the event buttons 80, 81, 82 are associated with different actions for different button modes.

With the program routine storage mode selected, the user will then select or program the dance maneuvers associated with the particular program routine storage mode. In order to do so, the user will select the button mode, by pressing or activating the SELECT or other button 51. The indicator 52 of at least one embodiment will change colors each time the SELECT or other like button mode selection button 51 is pressed. With the button mode selected, the user may use the pre-designated dance maneuver buttons 60-74 in order to select and customize the dance routine.

As a non-limiting illustrative example, FIGS. 5A through 5J show different dance maneuvers that may be associated with the different buttons 60-74. For instance, the chart shown in FIG. 6 provides an exemplary illustration of the various dance maneuvers associated with the various button modes and buttons on the remote control. Selection of the indicated button, while in the particular button mode and a program mode, will program that dance maneuver for subsequent execution.

For instance, FIGS. 6A, 6B and 6C are provided as exemplary dance maneuvers showing that a single button may correspond with different dance maneuvers or actions, and that each dance maneuver or action may take a different amount of time to execute or complete. The times and dance maneuvers shown in FIGS. 6A, 6B and 6C should be deemed illustrative only and should not be limiting. Other buttons, for example, button 80-83 may be used to program additional maneuvers, may execute the dance routine, may be used to change or select the program routine storage mode, may be used to play demo dances or performances, etc. depending on the button mode, for example. Further, as noted herein, when pre-programming the dance routine, the user must coordinate the timing of the dance maneuvers with the timing of the song or the dance portion of the song. Failure to do so may require the user to begin again and reprogram the figurine 10 with a different set of dance maneuvers.

As an example, the following songs may be used in accordance with the various embodiments of the present invention, although as noted herein, other songs, biblical verses, etc. may be used.

"All You Need Is Love"—dance time: 2 minutes, 25 seconds.
"We Are Family"—dance time: 2 minutes, 8 seconds.
"Don't You Forget About Me"—dance time: 3 minutes, 50 seconds.
"Love Me Do"—dance time: 2 minutes, 5 seconds.
"You've Lost That Lo'vin Feel'in"—dance time: 2 minutes, 10 seconds.
"I'm a Believer"—dance time: 2 minutes, 24 seconds.
"Spirit in the Sky"—dance time: 2 minutes, 30 seconds.

This written description provides an illustrative explanation and/or account of the present invention. It may be possible to deliver equivalent benefits and insights using variations of the sequence, steps, specific embodiments and methods, without departing from the inventive concept. This description and these drawings, therefore, are to be regarded as illustrative and not restrictive.

Now that the invention has been described,

What is claimed is:

1. A method of conducting a dance routine with a programmable dancing figurine, the method comprising:

selecting at least one song, defining a dance portion of the song as comprising a portion of the song beginning at a first lyric and ending at a last lyric, determining a length of time corresponding to the dance portion of the at least one song, pre-programming the dance routine with a remote control, the remote control comprising a plurality of buttons and being disposed in a communicative relation with the dancing figurine, wherein pre-programming the dance routine comprises:

selecting one of a plurality of button modes via the remote control, the plurality of button modes being structured to define an action associated with a corresponding button on the remote control, wherein at least some of the buttons are associated with a different action for each of the plurality of button modes, selecting a dance maneuver via activation of one of the plurality of buttons while the remote control is in one of the plurality of button modes, repeating the selecting one of a plurality of button modes and the selecting a dance maneuver to program a plurality of sequential dance maneuvers, playing the at least one song, and executing the pre-programmed dance routine upon commencement of the dance portion of the at least one song.

2. The method as recited in claim 1 wherein pre-programming the dance routine further comprises repeating the selecting one of a plurality of button modes and the selecting a dance maneuver until the dance routine comprising a plurality of successive dance maneuvers comprises a length of time substantially equal to the length of time corresponding to the dance portion of the at least one song.

3. The method as recited in claim 1 wherein pre-programming the dance routine further comprises selecting a program routine storage mode via the remote control.

4. The method as recited in claim 3 wherein selecting a program routine storage mode comprises selecting one a plurality of at least three program routine storage modes.

5. The method as recited in claim 4 wherein the plurality of at least three program routine storage modes comprises a master program mode and at least two secondary program modes.

6. The method as recited in claim 5 wherein each of the plurality of at least three program routine storage modes is associated with a different dance routine.

7. The method as recited in claim 6 wherein executing the dance routine associated with at least one of the plurality of program routine storage modes comprises selecting a corresponding execution button on the remote control.

8. The method as recited in claim 6 wherein executing the dance routine associated with at least one of the plurality of program routine storage modes comprises activating a touch sensor disposed on the programmable dancing figurine.

9. The method as recited in claim 1 further comprising defining the plurality of button modes as comprising at least three different button modes, wherein at least some of the buttons of the remote control are associated with at least three different actions, one for each of the at least three different button modes.

10. The method as recited in claim 9 further comprising displaying a colored light indicator on the remote control for indicating activation of a corresponding one of the plurality of at least three different button modes, wherein each of the plurality of at least three different button modes corresponds with a different color.

11. A method of conducting a dance routine with a programmable dancing figurine, the method comprising:

selecting at least one song, defining a dance portion of the song as comprising a portion of the song beginning at a first lyric of the song and ending at a last lyric of the song, determining a length of time corresponding to the dance portion of the at least one song, pre-programming the dance routine with a remote control, the remote control comprising a plurality of buttons and being disposed in a communicative relation with the dancing figurine, wherein pre-programming the dance routine comprises:

selecting one of a plurality of at least three button modes via the remote control, each of the plurality of at least three button modes being structured to define an action associated with a corresponding button on the remote control, wherein at least some of the buttons are associated with a different action for each of the plurality of at least three button modes, displaying a colored light indicator on the remote control for indicating activation of a corresponding one of the plurality of at least three button modes, wherein each of the plurality of at least three different button modes corresponds with a different color, selecting a dance maneuver via activation of one of the plurality of buttons, repeating the selecting one of a plurality of button modes and the selecting a dance maneuver to program a plurality of sequential dance maneuvers, playing the at least one song, and executing the dance routine upon commencement of the dance portion of the at least one song.

12. The method as recited in claim 11 wherein programming the dance routine further comprises repeating the selecting one of a plurality of button modes and the selecting a dance maneuver until the dance routine comprising a plurality of successive dance maneuvers comprises a length of time substantially equal to the length of time corresponding to the dance portion of the at least one song.

13. The method as recited in claim 11 wherein pre-programming the dance routine further comprises selecting one of a plurality of program routine storage modes via the remote control, wherein each of the plurality of program routine modes is associated with a set of successive dance maneuvers.

14. The method as recited in claim 11 further comprising defining the dancing figurine as being visually representative of a religious figure.

15. The method as recited in claim 14 further comprising defining the dancing figurine as being visually representative of a biblical figure.

* * * * *